United States Patent [19]

Bigo

[11] Patent Number: 5,018,433

[45] Date of Patent: May 28, 1991

[54] MECHANISM EMPLOYING FLUID UNDER PRESSURE PROVIDED WITH A ROTOR, A STATOR AND A DEVICE FOR ASSEMBLING THESE TWO ELEMENTS

[75] Inventor: Louis B. Bigo, Compiegne, France

[73] Assignee: Poclain Hydraulics, Societe Anonyme, Verberie, France

[21] Appl. No.: 257,457

[22] Filed: Oct. 13, 1988

[30] Foreign Application Priority Data

Oct. 16, 1987 [FR] France ..... 87 14334

[51] Int. Cl.[5] ..... F01B 13/06; F04B 19/02

[52] U.S. Cl. ..... 91/498; 417/273; 417/462

[58] Field of Search ..... 91/491, 492, 497, 498; 417/462, 463, 269, 273

[56] References Cited

U.S. PATENT DOCUMENTS 932,033 8/1909 Krone ..... 91/497
4,157,056 6/1979 Allart et al. ..... 91/491

FOREIGN PATENT DOCUMENTS 1653506 10/1970 Fed. Rep. of Germany .
2551826 5/1977 Fed. Rep. of Germany ..... 91/491
2533965 9/1982 France .
881058 11/1961 United Kingdom .

*Primary Examiner*—Leonard E. Smith
*Assistant Examiner*—John A. Sanio, III
*Attorney, Agent, or Firm*—Weingarten, Schurgin, Gagnebin & Hayes

[57] ABSTRACT

This invention relates to a mechanism employing fluid under pressure, comprising: a stator; a rotor; a device for assembling the rotor with respect to the stator, effecting relative rotational assembly of these two elements about a geometrical axis, and ensuring axial holding of said two elements in position, in the two opposite directions, parallel to said geometrical axis; a reaction cam fast with a first of said elements; cylinders made in the second element and disposed radially with respect to said geometrical axis; and pistons mounted in said cylinders and abutting on said cam. According to the invention, the assembly device is constituted by a single bearing which comprises: two rolling tracks made directly on an extension of the reaction cam itself, and on an extension of the element itself in which the cylinders are made, respectively; rolling members disposed between the tracks, capable of abutting on these two tracks so as to ensure axial holding of the rotor with respect to the stator. One application is the production of a compact hydraulic motor.

2 Claims, 1 Drawing Sheet

I
II
D1
D2
R7
R5
P22

MECHANISM EMPLOYING FLUID UNDER PRESSURE PROVIDED WITH A ROTOR, A STATOR AND A DEVICE FOR ASSEMBLING THESE TWO ELEMENTS

FIELD OF THE INVENTION

The present invention relates to a mechanism employing fluid under pressure, provided with a rotor, a stator and a device for assembling these two elements.

BACKGROUND OF THE INVENTION

FR-A-2 533 965, for example, already discloses a mechanism employing fluid under pressure, such as a hydraulic pump or motor, comprising: a stator; a rotor; a device for assembling the rotor with respect to the stator, such that these two elements rotate relatively about a geometrical axis and said two elements are maintained axially in position, in the two opposite directions parallel to said geometrical axis; a reaction cam fast with a first of said two elements; cylinders arranged in the second of these two elements and disposed substantially radially with respect to said geometrical axis of rotation; and pistons mounted to slide in said cylinders and bearing on said cam.

Constant research has been carried out with regard to these known mechanisms, motors or pumps, with a view to reducing their space requirement, both radial and axial. However, such research has been limited to a certain extent, as the designers, up to the present time, have had to provide at least two sets of bearings in order to ensure rotational assembly and axial holding of the rotor with respect to the stator. Such bearings are either mixed, each of them producing both part of the rotational assembly and part of the axial holding, or each being of one type, one of the bearings producing rotational assembly, and one or more other bearings effecting axial holding.

It is an object of the present invention to propose a novel bearing arrangement which considerably reduces the axial and radial space requirement of said mechanisms, whilst conserving at least the same endurance and having mechanical aptitudes (fatigue strength, recovery of moments) at least equal to those of the known mechanisms.

SUMMARY OF THE INVENTION

To that end, in a mechanism as defined previously, the assembly device according to the invention is constituted by a single bearing which comprises two rolling tracks made directly on an extension of the reaction cam itself, and on an extension of the element itself in which the cylinders are made, respectively; and rolling members disposed between said tracks, capable of abutting on these two tracks so as to ensure axial holding, in the two opposite axial directions parallel to the geometrical axis, of the rotor with respect to the stator.

The following advantageous arrangements are also preferably adopted:

the rolling members are constituted by balls capable of being in abutment on two distinct contact zones of each track and constituting axial stops in the two opposite axial directions parallel to the geometrical axis of rotation;

the mean diameter of the bearing on which are located the axes of rotation of the various rolling members has a value substantially equal to the diameter enveloping the outer periphery of the element in which the cylinders are made.

The advantages following from the adoption of the features according to the invention effectively reside in a reduction in axial and radial space requirement of the mechanism in which they are employed, caused in particular by the elimination of at least one bearing with respect to the heretofore known mechanisms; likewise by the elimination of the rings of the separate bearings; and by the judicious choice of the location (distance) of the single bearing with respect to the geometrical axis of rotation.

BRIEF DESCRIPTION OF THE DRAWINGS

The invention will be more readily understood on reading the following description with reference to the accompanying drawings, in which.

DETAILED DESCRIPTION OF THE DRAWINGS

Figures 1, 2:
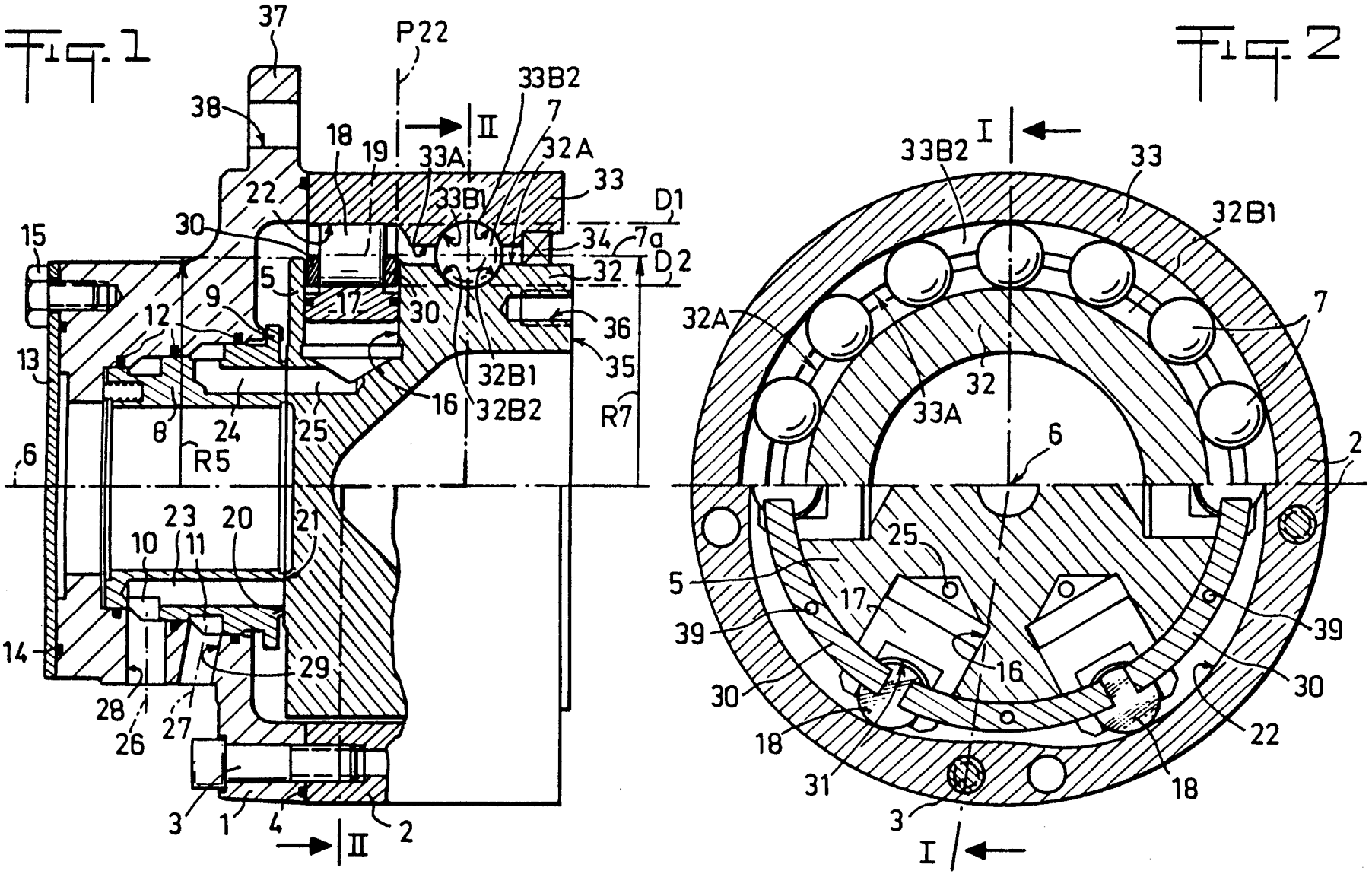
FIG. 1 is an axial section, along I—I of FIG. 2, through a hydraulic motor according to the invention.
FIG. 2 is a section along II—II of FIG. 1.

Referring now to the drawings, the hydraulic motor comprises:

a housing in two parts 1 and 2 assembled by screws 3, with the interposition of an O-ring 4;

a cylinder block 5 which is rotatably mounted substantially within the housing 1-2 about a geometrical axis of rotation 6, by means of balls 7 interposed between it and the housing;

a fluid distribution face 8 which is maintained fast in rotation with part 1 of the housing by means of an assembly of catches and notches 9 and which, with this part 1 of the housing, defines two grooves 10, 11, isolated by O-rings 12;

a cover 13 which obturates the axial end of part 1 of the housing, with interposition of an O-ring 14 between the cover and this part 1, and which is fixed on part 1 by screws 15.

Cylinders 16 are made in the cylinder block 5, disposed radially and regularly spaced apart angularly. Pistons 17 are mounted to slide inside the cylinders 16, one per cylinder, and their outer ends are provided with rollers 18, of which the axes 19 are parallel to the geometrical axis 6.

The cylinder block 5 and the distribution face 8 each have a plane face 20, 21 respectively, these two faces being perpendicular to the geometrical axis 6 and being maintained in abutment on each other. The inner face of part 2 of the housing constitutes an undulated cam 22 on which the various rollers 18 are in abutment. Two pluralities of conduits 23, 24 connect, conduits 23, the groove 10 to the plane face 21 of the distribution face 8, and conduits 24, the groove 11 to the same plane face 21, opening out in this plane face 21 via orifices disposed regularly on the same circle centred on the geometrical axis 6, these conduits 23 and 24 being alternate. Furthermore, conduits of cylinders 25 connect cylinders 16 to the plane face 20 of the cylinder block, one conduit per cylinder, opening out in this plane face 20 via orifices disposed regularly on the same circle centred on the geometrical axis 6 and capable of communicating alternately with a conduit 23, then with a conduit 24, and so on, of the distribution face 8. Finally, grooves 10, 11 are connected to outer conduits 26, 27 via connections 28, 29 respectively, these conduits 26, 27 conveying a fluid under pressure and a fluid without pressure, and vice versa, respectively.

Segments 30 of rings for axially holding the rollers 18 in housings 31, which are made in pistons 17, are fixed (screws 39) on the cylinder block 5 and constitute supports for the end transverse edges of the rollers 18.

On the cylinder block 5 side opposite, with respect to cylinders 16, that where the distribution face 8 is located, the cylinder block 5 is provided with an extension 32 and part 2 of the housing is also provided with an extension 33, these extensions 32 and 33 extending in an axial direction substantially parallel to the geometrical axis 6, from the transverse plane $P_{22}$ up to which cam 22 extends, so as to constitute the supports of surfaces 32A, 33A respectively, which are disposed opposite each other and of which the outlines, in the plane of axial section of FIG. 1, are included between the straight lines D1, D2 parallel to the geometrical axis 6 passing through the generatrices of the rollers 18 contained in the plane of section, or close to these straight lines D1, D2. Extension 32 is an integral part of the cylinder block 5, in the same way as extension 33 is an integral part of part 2 of the housing in which the cam 22 is machined.

The ball bearing 7 comprises a rolling track 32B1-32B2 made directly in the extension 32 itself, a rolling track 33B1-33B2 made directly in the extension 33 itself and, of course, the spherical balls 7 disposed between said tracks. Track 32B1-32B2 opens out in the surface 32A of the extension 32 and comprises two distinct faces 32B1 and 32B2 oriented axially in opposite directions and constituting two axial shoulders. Similarly, track 33B1-33B2 opens out in the surface 33A of the extension 33 and comprises two distinct faces 33B1 and 33B2 oriented axially in opposite directions and constituting two axial shoulders. The balls 7 are capable of being in abutment either on a contact zone of face 32B1 and on a contact zone of face 33B1 and of preventing axial displacement of the rotor with respect to the stator in a first axial direction (towards the right), parallel to the axis of rotation 6, or on a contact zone of face 32B2 and on a contact zone of face 33B2 and of preventing axial displacement of the rotor with respect to the stator in the axial direction (towards the left) opposite said first direction. Finally, the said two tracks and the balls 7 are sufficient to effect, on the one hand, rotational assembly of the rotor (housing 1-2, its extension 33 and cam 22) with respect to the stator (cylinder block 5 and its extension 32) about the geometrical axis of rotation 6, and, on the other hand, axial holding of said rotor with respect to the stator in the two opposite axial directions, parallel to the direction of the axis of rotation 6. An O-ring 34 is interposed between the ends of extensions 32 and 33. Finally, in the outer end transverse face 35 of the extension 32 of the cylinder block 5, are made bores 36 allowing fixation of the cylinder block and its extension, for example on the wheel of a vehicle, whilst part 1 of the housing comprises a flange 37, provided with holes 38, for fixing the housing 1-2, for example on the chassis of a vehicle. The balls of this ball bearing are introduced between tracks 32B and 33B via an introduction well (not shown in the drawings). They may be contiguous or, on the contrary, maintained spaced apart by distance pieces, or maintained, in conventional manner, in a ball cage.

It should further be noted that the circle of radius R7, centered on the geometrical axis of rotation 6, on which are located axes 7A of rotation of the various balls, merges substantially, in the embodiment described, with the circle of radius R5, likewise centred on the geometrical axis of rotation 6, which constitutes the envelope of the outer periphery of the cylinder block 5 and on which the axes 19 of the rollers 18 substantially lie.

Operation of the motor which has just been described is conventional. When conduit 26 conveys fluid under pressure and conduit 27 conveys fluid without pressure, a relative rotation is effected, in a first direction of rotation, of the cylinder block 5 with respect to the casing 1-2. When conduit 26 conveys fluid without pressure and conduit 27 conveys fluid under pressure, a relative rotation is effected in the second direction of rotation opposite the first direction of rotation.

The advantages of such a motor lie principally in its radial and axial compactness. Such compactness is obtained by the choice of the device for assembling the housing 1-2 with respect to the cylinder block 5: a single bearing (32B1-32B2-33B1-33B2-7) allows such assembly and is obviously less cumbersome in the axial direction, parallel to the geometrical axis 6, than the assembly used heretofore by two or more than two bearings, and is also less cumbersome in the radial direction, since its rolling tracks (32B1-32B2-33B1-33B2) are machined directly on the housing (1-2-33) and on the cylinder block (5-32), thus eliminating the rolling rings of the prior known bearings which were distinct (the rolling rings) from the rotationally mounted elements.

It should be noted that the recommended assembly device performs all the necessary functions: relative rotational assembly and axial holding of the housing (1-2-33) with respect to the cylinder block (5-32).

When, in addition, the efforts and the moment that the bearing must support are considerable, it is advantageous to choose the radius R7 substantially equal to radius R5, which gives the bearing the desired mechanical strength. This arrangement also avoids the changes in radial dimensions and thus allows an additional reduction of the axial space requirement of the motor, and this whatever the value of the efforts and moment having to be supported. In fact, the fact of having placed the ball bearing 7 in the immediate proximity of the cam 22 and substantially at the same distance as the latter with respect to the geometrical axis 6, eliminates the setback, observed in numerous prior embodiments, bringing nearer to the geometrical axis 6 the parts of the cylinder block and the housing supporting this bearing, which setback caused an increase in the axial space requirement of the motor with respect to the arrangement according to the invention.

A variant embodiment according to the invention adopts a roller bearing instead of the ball bearing 7.

The invention is not limited to the embodiment illustrated, but covers, on the contrary, all the variants which may be made thereto without departing from the scope nor spirit thereof.

What is claimed is:

1. In a mechanism employing fluid under pressure, such as a hydraulic pump or motor, comprising:

a stator, a rotor, a device for assembling the rotor with respect to the stator, effecting relative rotational assembly of these two elements about a geometrical axis, and ensuring axial holding of said two elements in position, in the two opposite directions, parallel to said geometrical axis;

a reaction cam fast with one of said stator and rotor;

cylinders made in the other of said stator and rotor and disposed substantially radially with respect to said geometrical axis of rotation; and pistons mounted to slide in said cylinders, each of said pistons including a rolling element abutting on said cam;

the assembly device in constituted by a single bearing which comprises:

two rolling tracks made directly on an extension of the reaction cam itself, and on an extension of the element itself in which the cylinders are made, respectively;

rolling members disposed between said tracks, capable of abutting on these two tracks so as to ensure axial holding, in the two opposite axial directions parallel to the geometrical axis, of the rotor with respect to the stator, and wherein the axes of the assembly device rolling members are disposed on a circle whose radius from said geometrical axis is substantially equal to the radius of a circle enveloping the outer periphery of the element in which the cylinders are made.

2. The mechanism of claim 1, wherein the rolling members are constituted by balls capable of being in abutment on two distinct contact zones of each track and constituting axial stops in the two opposite axial directions parallel to the geometrical axis of rotation.

* * * * *